US005641399A

United States Patent [19]

Rawlins

[11] Patent Number: 5,641,399

[45] Date of Patent: Jun. 24, 1997

[54] AIR DEVELOPMENT SYSTEM FOR A POOL CLEANING DEVICE

[76] Inventor: David Jesse Rawlins, P.O. Box 188112, Sacramento, Calif. 95818

[21] Appl. No.: 418,496

[22] Filed: Apr. 7, 1995

[51] Int. Cl.[6] ..... E04H 4/16

[52] U.S. Cl. ..... 210/169; 210/416.2; 4/496; 15/1.7; 417/65; 417/92; 417/104

[58] Field of Search ..... 417/65, 92, 104; 210/169, 416.2; 4/496; 15/1.7

[56] References Cited

U.S. PATENT DOCUMENTS

| | | | |
|---|---|---|---|
| 479,530 | 7/1892 | Roberts . | |
| 2,345,243 | 3/1944 | Eakin | 46/92 |
| 3,382,606 | 5/1968 | Johnson | 46/91 |
| 3,384,914 | 5/1968 | Wilhelmsen | 15/1.7 |
| 3,675,261 | 7/1972 | Burgess et al. | 15/1.7 |
| 3,936,214 | 2/1976 | Zupanick . | |
| 4,448,409 | 5/1984 | Kaga et al. | 272/8 N |
| 4,641,679 | 2/1987 | Arnaudeau et al. . | |
| 4,686,728 | 8/1987 | Rawlins | 15/1.7 |
| 4,776,954 | 10/1988 | Brooks | 210/169 |
| 4,837,886 | 6/1989 | Rawlins | 15/1.7 |
| 5,029,600 | 7/1991 | McCullagh | 137/1 |
| 5,139,659 | 8/1992 | Scott | 210/169 |
| 5,256,282 | 10/1993 | Chang et al. | 210/169 |
| 5,336,401 | 8/1994 | Tu | 210/169 |
| 5,363,877 | 11/1994 | Frentzel et al. | 137/526 |

OTHER PUBLICATIONS

Hayward® Bulletin 21–88; The New Super Pump® 2 pages; ©1990.

Hayward® Bulletin 17–87; S–200 High rate Sand Filters; 2 pages; ©1989.

*Primary Examiner*—Robert J. Popovics

*Attorney, Agent, or Firm*—Bradley P. Heisler

[57] ABSTRACT

A swimming pool cleaning system 2 is provided which provides both water suction and compressed air to a pool cleaning device. A pump 20 draws water form a swimming pool P through the pool cleaning device, an attached vacuum hose 14 and a suction line 12. An air inlet port 10 enters the suction line 12 adjacent the pump 20. The pump 20 then compresses the air A and pumps the water to a higher pressure simultaneously. The pump 20 is followed by a main pool filter 40 in which the water is filtered and returned to the pool P and the compressed air A is separated. A compressed air outlet 50 draws the compressed air A out of the main pool filter 40 and delivers the compressed air A to the pool cleaning device along a compressed air supply line 58. The air inlet port 10 includes a hollow inner tube segment 60 partially surrounded by a resilient outer sleeve 70. A hole 66 in the inner tube segment 60 and beneath the outer sleeve 70 delivers air A into the suction line 12 only when pressure within the suction line 12 is sufficiently low to pull the outer sleeve 70 away from the inner tube segment 60. The air inlet port 10 is oriented directly adjacent the pump 20 so that a minute steady stream of air A is supplied to the pump 20 without overloading the pump 20 or causing the pump 20 to cavitate.

22 Claims, 2 Drawing Sheets

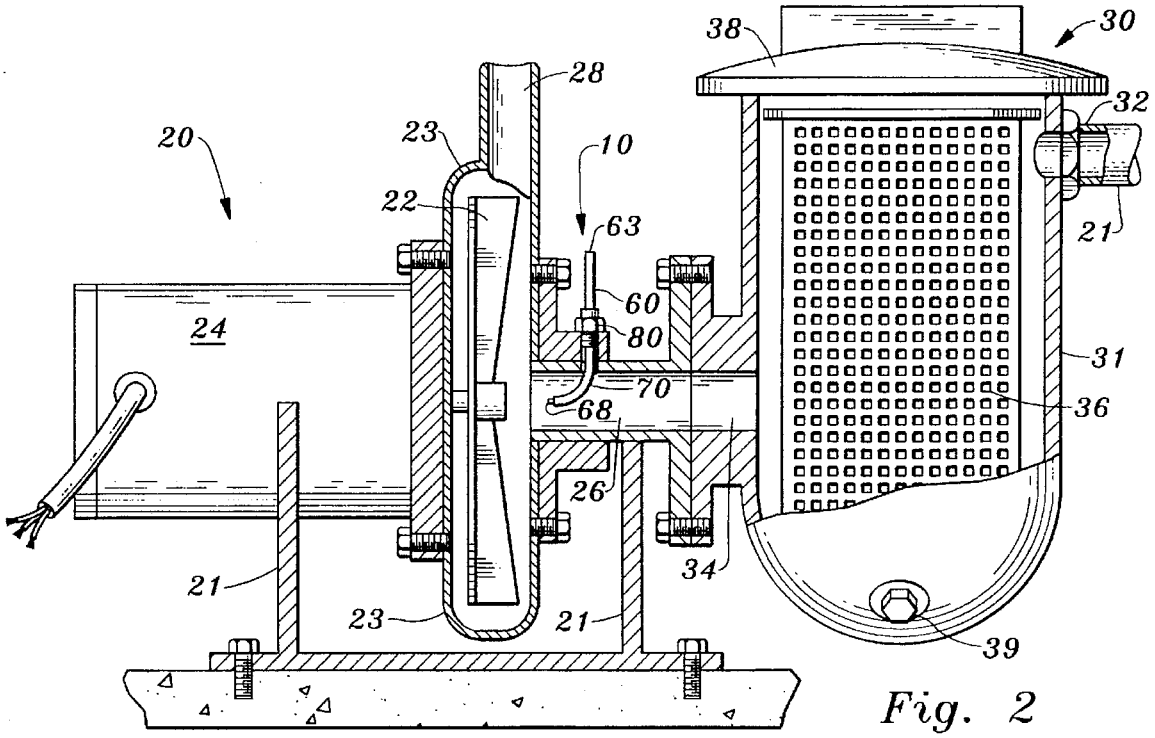
Fig. 2
Fig. 3
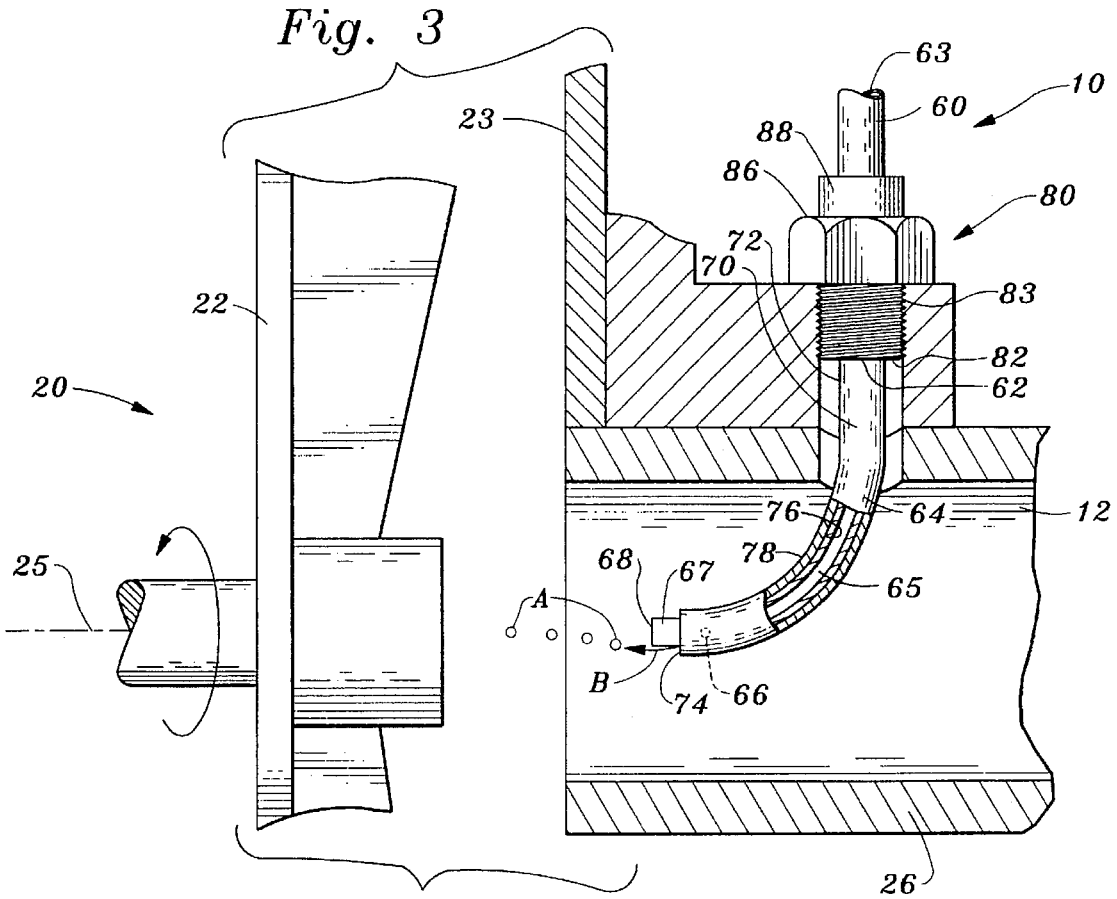

AIR DEVELOPMENT SYSTEM FOR A POOL CLEANING DEVICE

FIELD OF THE INVENTION

The following invention relates to swimming pool cleaning devices and other devices which require both a source of compressed gas such as air and a liquid suction line. More specifically, this invention relates to systems which utilize a pump to simultaneously generate water suction within a swimming pool cleaning device and compressed air for use with the pool cleaning device.

DESCRIPTION OF THE RELATED ART

Numerous different pool cleaning devices are known in the art for removing debris from a swimming pool and systematically filtering the water to keep the pool clean. Some of the most effective pool cleaning devices migrate around the pool both above and below the surface to capture debris and scour the walls of the pool. Some devices include water suction inlets thereon while others merely agitate the debris so that a suction inlet in another area of the pool is more likely to capture the debris. These moving cleaning devices are driven by a variety of power sources. One power source which has exhibited particular success is compressed air.

Compressed air driven pool cleaning devices, such as the Pool Cleaning Device taught by U.S. Pat. No. 4,837,886, utilize compressed air to alter a vertical position of the device. The device includes a water suction inlet thereon which captures debris from all pool locations, both on the surface and below the surface. To function, the device requires a source of compressed air and a source of water suction.

Other pool cleaning devices and related pool systems, such as spa air jets, are conceivable which would also require both a source of compressed air and water suction to function. While water pumps are known in the art for generating water suction within a swimming pool, these water pumps are not currently capable of also supplying compressed air. Rather, when compressed air has previously been needed in the swimming pool environment, a separate air compressor has been used. While such air compressors are known in the art, they add complexity, noise and cost to any pool cleaning device or other pool system. Hence, a need exists for a simplified way to provide both water suction and compressed air in the swimming pool environment.

In the aquarium arts, devices have been developed for aerating the water within an aquarium. While some of these devices include pump-like devices to mix the water with the air, these devices either do not compress the air, as is the case with U.S. Pat. No. 5,336,401 to Tu, or utilize a separate air compressor to provide air compression, as is the case with U.S. Pat. No. 5,139,659 to Scott and U.S. Pat. No. 5,256,282 to Chang et al. Thus, either no air is compressed or the added complexity of an air compressor is still required.

SUMMARY

The present invention provides a system for simultaneous generation of water suction and air compression within a single pumping device. The system includes a suction line extending between a low pressure side of the pump and a swimming pool or other liquid source. A high pressure side of the pump is provided opposite the low pressure side of the pump.

A gas inlet port is oriented on the suction line in a manner allowing gas, such as air, to pass into the suction line. The gas passes through the pump along with the liquid in the suction line. Once on the high pressure side, the gas exhibits an elevated pressure. This gas is then separated from the liquid for use with the pool cleaning device or other system utilizing compressed gas.

The gas inlet port can be oriented in a variety of positions, such as directly adjacent an impeller of the pump or at a point where the suction line exits the swimming pool. The port includes a valve thereon which prevents air or other gas from passing into the suction line except when the pressure within the suction line is below atmospheric pressure. The valve thus prevents air from entering the suction line when the pump is not in operation and when the pump is initially starting operation.

By incorporating the air compressor with the water pump, the complexity of the overall pool cleaning system is minimized. Many swimming pools already utilize a water pump for circulating pool water through a filter. By merely adding the air inlet port to the pump, a source of compressed air is provided which can be tapped out of a housing of the pool filter. Thus, a pool cleaning device requiring a source of compressed air can be fitted on such a pool without requiring a separate air compressor.

This invention exhibits other objects, such as providing a new source of compressed gas in systems where a liquid pump is already included. This invention provides a more efficient solution to the problem of providing a source of compressed air for pool cleaning systems. Rather than generating water suction by use of alternating valves or other complex systems, this system draws water from the pool cleaning device within the pool directly to the pump, without obstruction. Thus, pump strain and wear are greatly reduced. The small amount of air drawn into the pump for air compression does not have a significant affect on pump performance. No additional water pump, often called a booster pump, need be used, as is the case with other systems. Thus, an energy efficiency of the overall pool cleaning system is significantly enhanced.

This system also enhances pool filter performance. Air gradually collects in most pool filter housings over time. If a user does not manually operate an air bleed valve located on the filter housing, the filter can become "air-logged". An upper portion of the filter fills with air, forcing a water level within the filter down. The housing can then get excessively hot, especially on hot summer days. The filter element itself is then exposed to the hot air so that not all of the filter gets used and resulting in damage to the filter. This system automatically draws air out of the filter housing, eliminating this problem.

This invention can generate compressed air by modifying an existing liquid pump in a simple manner with the use of readily available, durable materials. This invention decreases wear on liquid pumps during start-up by providing a source of compressible fluid for a high pressure side of the pump, decreasing an initial load on the pump. This invention provides a valve which prevents the suction line on the low pressure side of the pump from receiving an excessive amount of gas and which meters flow of gas through the pump below levels at which the pump could be damaged or would exhibit significantly degraded performance. This invention can be incorporated into a new pump design which exhibits simultaneous air compression and water pumping capabilities with a single motor and a single impeller.

The above recited advantages, by way of example, provide many of the primary objects for this invention. In addition, various other objects will become apparent upon a careful reading of the specification as a whole and upon consideration of the claims.

BRIEF DESCRIPTION OF THE DRAWINGS

FIG. 2 is an elevation view of a pump of this invention and related structure with portions thereof shown in section to reveal interior details.

FIG. 3 is a detail of a portion of the pump of FIG. 2 adjacent the impeller, at which air is delivered into the pump for compression.

DESCRIPTION OF THE PREFERRED EMBODIMENT

Figure 1:
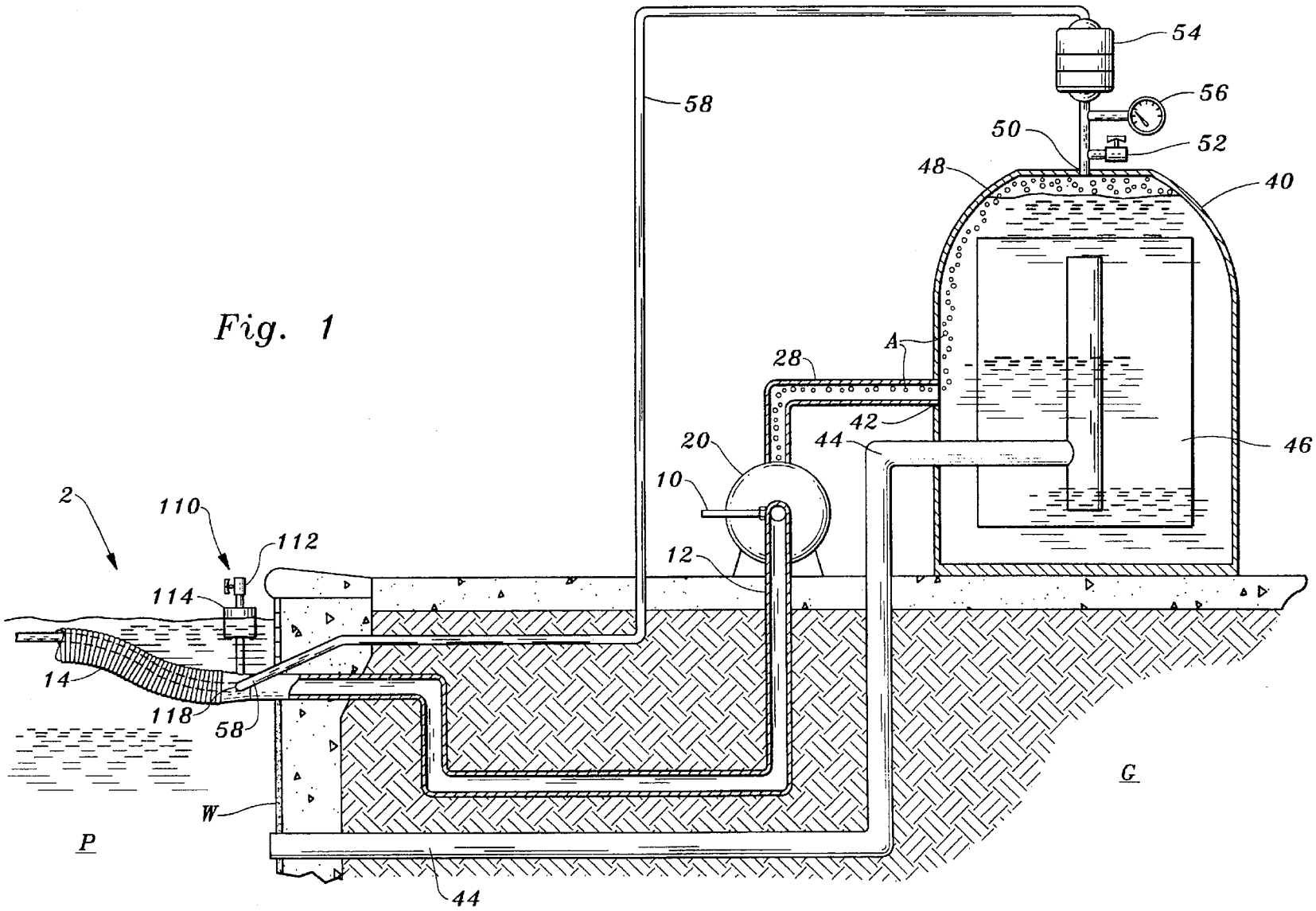
FIG. 1 is an elevation view of the invention incorporated into a swimming pool cleaning system. For simplicity, a pool cleaning device, oriented within the swimming pool and utilizing compressed air and water suction provided by this invention, is not shown.

With reference now to the drawing figures, a swimming pool cleaning system 2 (FIG. 1) is shown which provides compressed air and water suction for a swimming pool cleaning device. Compressed air is generated by allowing air to pass from an air inlet port 10 through a pump 20 along with water from a suction line 12. The suction line 12 is connected to the pool cleaning device, within a swimming pool P, through the pool cleaning device hose 14.

In essence, and with primary reference to FIG. 1, the pool cleaning system 2 includes a series of interconnected fluid handling components which service a pool cleaning device (not shown) which requires a source of compressed air and a source of water suction to operate. One such pool cleaning device is disclosed in detail in U.S. Pat. No. 4,837,886 and is incorporated herein by reference. Details of this pool cleaning device will not be recited except to note that the pool cleaning device preferably receives the water suction and compressed air through a vacuum hose 14 with a compressed air supply line 58 nested therein.

The vacuum hose 14 is provided with a pressure below atmospheric pressure by action of a pump 20 coupled to the vacuum hose 14 through a suction line 12 on a low pressure side of the pump 20. A high pressure side of the pump 20, opposite the suction line 12, leads to a main pool filter 40 where the pool water can be cleansed of small particle debris. A return 44 directs the water back to the swimming pool P.

To provide compressed air, an air inlet port 10 is oriented upon the suction line 12. The air inlet port 10 directs air into the suction line 12 so that the air is caused to pass through the pump 20 and be pressurized along with the water. The compressed air collects in the filter 40 where it is removed through a compressed air outlet 50. The compressed air outlet 50 is coupled to the compressed air supply line 58 which extends to the pool cleaning device within the vacuum hose 14.

More specifically, and with particular reference to FIG. 1, details of water circulation within the pool cleaning system 2 are provided. Initially, water within the pool P exhibits a pressure which varies based on the distance of the water from the pool P surface. All of the water exhibits at least atmospheric pressure if not elevated pressure corresponding to its depth. The pool cleaning device (not shown) includes a water inlet which draws water from the pool P into the vacuum hose 14. The vacuum hose 14 is an elongate flexible cylindrical tube extending from the pool cleaning device to the suction line 12 at the pool wall W. Because the vacuum hose 14 is coupled, through the suction line 12, to a low pressure side of the pump 20, a pressure within the vacuum hose 14 and suction line 12 is below atmospheric pressure. Hence, water is drawn into the vacuum hose 14 at the water inlet along with debris within the pool P.

The suction line 12 is similar to the vacuum hose 14 except that it is preferably rigid and buried under the ground G surrounding the pool P. The suction line 12 leads from the pool P to the pump 20 which is ordinarily spaced from the pool P to reduce noise surrounding the pool P. The suction line 12 terminates at a portion of the pump 20 where an impeller 22 increases the pressure of the water.

With particular reference to FIG. 2, the pump 20 is preferably powered by an electric motor 24 and has a centrifugal impeller 22 which is rotated within an impeller housing 23 by the motor 24. The pump 20 is supported on the ground G by a rigid ground mount 21. The impeller housing 23 includes a low pressure conduit 26 entering the housing 23 along a central axis 25 and a high pressure conduit 28 exiting the impeller housing 23 near a peripheral edge of the housing 23. The low pressure conduit forms a portion of the suction line 12.

A debris filter 30 is preferably oriented between the suction line 12 and the low pressure conduit 26 of the pump 20 to capture large debris, such as leaves, before it enters the impeller housing 23. The debris filter 30 includes a housing 31 including an entrance 32 and an exit 34. The entrance 32 is coupled in series with the suction line 12. The exit 34 is coupled to the low pressure conduit 26 of the pump 20. A removable leaf basket 36 is interposed between the entrance 32 and the exit 34. A removable lid 38 covers the housing 31 and allows access to the leaf basket 36 for cleaning. A drain plug 38 is oriented at a lower end of the housing 31 to facilitate periodic draining of the housing 31. To maintain low pressure within the suction line 12 and vacuum hose 14, the lid 38, housing 31 and drain 39 must all be substantially air tight.

The high pressure conduit 28 directs high pressure water, pressurized by the impeller 22 of the pump 20 within the impeller housing 23, to the main pool filter 40. The main pool filter 40 is oriented within a sealed housing 41 which allows pressures above atmospheric pressure to be maintained. Water enters the housing 41 through an input 42 coupled to the high pressure conduit 28. A return 44 directs water out of the housing 41 and back to the pool P.

A filter 46 is interposed between the input 42 and the return 44 within the housing 41. This filter 46 preferably exhibits a finer mesh than does the leaf basket 36. Hence, the leaf basket 36 collects large debris and the filter 46 collects small and microscopic debris. In combination, the pump 20, debris filter 30, and main pool filter 40 of the pool cleaning system 2 provide both the required source of water suction for the pool cleaning device and a filtration system for cleaning the pool P water passing through the pool cleaning system 2.

With particular reference to FIG. 3, details of air compression within the pool cleaning system 2 are provided. Air A is initially drawn into the pool cleaning system 2 through the air inlet port 10. The air inlet port 10 draws air A into the water at a location where pressure below atmospheric pressure is exhibited, between the vacuum hose 14 and the impeller housing 23 of the pump 20. Preferably, the air inlet port 10 is located on the low pressure conduit 26, directly adjacent the impeller housing 23. By locating the air inlet port 10 close to the impeller 22, a steady stream of air A can be introduced into the impeller housing 23 to prevent cavitation and disruption of pump 20 operation. The air inlet port 10 is valved to prevent air A from entering the low pressure conduit 26 except when the pressure therein is below atmospheric pressure. The air inlet port 10 is also valved to prevent too much air A from passing into the impeller housing 23.

Specifically, the air inlet port 10 includes an inner tube segment 60 having an open end 63 exposed to the outside atmosphere and a sealed end 68 opposite the open end 63. The inner tube segment 60 is preferably a cylindrical tube formed of semi-rigid nonreactive material, such as high density polypropylene. The inner tube segment 60 has a base 62 which is connected to an inner wall of the low pressure conduit 26. The inner tube segment 26 includes a curve 64 extending away from the base 62 and the open end 63, and toward the sealed end 68. Preferable, the sealed end 68 is oriented closest to the impeller 22 and aligned with the central axis 25 of the impeller 22. The inner tube segment 60 has an interior 65 and an exterior 67.

A hole 66, near the sealed end 68 of the inner tube segment 60, passes between the interior 65 and the exterior 67. The hole 66 is preferably approximately one half of an inch from the sealed end 68 and the inner tube segment 60 preferably has an outer diameter of one eighth of an inch. The hole 66 allows air 66 to pass into the low pressure conduit 26 for pressurization within the impeller housing 23 along with the water. The hole 66 is preferably sized small enough to only allow a small amount of air A to pass into the water.

An outer sleeve 70 surrounds the inner tube segment 60 within the low pressure conduit 26. The outer sleeve 70 includes a first end 72 overlying the base 62 of the inner tube segment 60 and a second end 74 extending beyond the hole 66. However, the second end 74 stops short of the sealed end 68 of the inner tube segment 60. Preferably, the second end 74 terminates one quarter of an inch from the sealed end 68. The outer sleeve 70 includes an inner surface 76 having a diameter similar to a diameter of the exterior 67 of the inner tube segment 60. The outer sleeve 70 includes an outer surface 78 opposite the inner surface 76.

A covering portion of the outer sleeve 70 covers the hole 66. An open portion of the outer sleeve 70 reveals part of the exterior 67 of the inner tube segment 60. The covering portion is spaced from the open portion. Preferably, the open portion is the second end 74 which terminates short of the sealed end 68 of the inner tube segment 60. If a higher power pump 20 is utilized, the distance from the open portion to the hole 66 can be increased by placing the hole 66 farther from the sealed end 68.

The outer sleeve 70 is a cylindrical tube formed of a resilient material such as the form of latex commonly used for surgical tubing. Hence, the covering portion effectively seals the hole 66 shut when no forces are acting on the outer sleeve 70. Because the air inlet port 10 is oriented within the low pressure conduit 26, the outer sleeve 70 of the air inlet port 10 has its exterior exposed to pressure below atmospheric pressure, so long as the pump 20 is in operation. The inner tube segment has its interior 65 exposed to atmospheric pressure through the open end 63. Hence, the pressure differential between atmospheric pressure and pressure within the low pressure conduit 26 causes the outer sleeve 70 to be drawn slightly away from the hole 66, allowing air A to pass out of the hole 66. The low pressure within the conduit 26 eventually draws the air A to the open portion of the outer sleeve 70, such as at the second end 74 of the outer sleeve 70, where the air A is then introduced into the water stream and is drawn into the impeller housing 23, along arrow B.

So long as the pump 20 continues to operate and low pressure is maintained in the low pressure conduit 26, air A will continue to be drawn into the low pressure conduit 26. If too much air A is drawn into the pump 20, the pump 20 will not draw as great a vacuum on the low pressure conduit 26, increasing a pressure therein. Hence, a rate of air A flow through the hole 66 will be decreased, allowing the pump 20 to draw a greater vacuum. In essence, the outer sleeve 70 provides a control system which automatically meters air A out of the hole 66 at a rate which the pump 20 can handle without excessive cavitation, or vacuum loss.

When the pump 20 stops, the outer sleeve 70 will once again seal the hole 66 closed so that no air A can enter the impeller housing 23. Thus, when the pump 20 is restarted, no air will be in the impeller housing 23, and the pump 20 can start without air A hampering its transition to full speed operation.

The air inlet port 10 can be retrofitted onto an existing swimming pool water circulation pump, such as the pump 20, by including a fitting 80 on the air inlet port 10. The fitting 80 includes an inner end 82 adjacent the base 62 with threads on an outer surface thereof. The low pressure conduit 26 is drilled and threaded in a manner accommodating the inner end 82 therein. The inner end 82 includes a bore for passage of the inner tube segment 60 therethrough. A lock-nut allows a common torque applying tool to orient the air inlet port 10 into the low pressure conduit 26. A Ferrule 88 provides a seal between the inner tube segment 60 and the fitting 80, to prevent air A or water from leaking through the fitting 80. Utilizing similar procedures and a similar fitting to the fitting 80, the air inlet port 10 can be located at a variety of locations along the low pressure conduit 26 or the suction line 12.

In an alternative embodiment, the air inlet port 10 is replaced with an air intake port 110. The air intake port 110 is oriented adjacent the pool wall W at a junction 118 between the suction line 12 and the vacuum hose 14. The intake port 110 includes a valve 112 thereon which is adjustable to meter a desired amount of air into the suction line 12. A float 114 can provide a shut off mechanism for the air intake port 110 if water within the pool P is too close to the valve 112.

With reference to FIG. 1, details of compressed air separation from the pool cleaning system 2 are provided. After air A is drawn through the impeller housing 23 (FIG. 2), the compressed air A and elevated pressure water exit into the high pressure conduit 28. The high pressure conduit 28 directs the compressed air A and the water into the main filter housing 41. Within the housing 41, the compressed air A migrates to an upper end 48 of the housing 41 by action of gravity. Hence, gravity provides a means to collect compressed air A at the upper end 48 of the housing 41. The compressed air outlet 50 extracts the compressed air A out of the filter housing 41, preventing the housing from being overfilled with compressed air A.

An added benefit of accommodating air A within the housing 41 is that when the pump 20 commences operation, it can work against a compressible fluid, air, rather than an incompressible fluid, water. This arrangement decreases strain on the pump 20 during start-up.

The compressed air outlet 50 includes a bleed valve 52 adjacent thereto for bleeding off excess compressed air A when desired. An air filter 54 is provided to keep water from passing along the compressed air supply line 58 and hampering operation of the pool cleaning device. A pressure gage 56 is oriented adjacent the compressed air outlet 50 to provide a user with information as to the pressure of the compressed air A and water within the housing 41.

The compressed air A is drawn through the filter 54 and then through the compressed air supply line 58. The compressed air supply line preferably passes into an interior of the vacuum hose 14 at the junction 118 and then on for use with the pool cleaning device. During operation of the pool cleaning device, compressed air is periodically allowed to exit the pool cleaning device, and reenter the atmosphere.

While the above description provides the preferred embodiment of this invention, other embodiments are also possible by incorporating the major elements of the system disclosed herein into other systems. For instance, a gas of any sort could be compressed along with a liquid of any sort without significant modification of this system. It is sometimes beneficial to condition water within a swimming pool or other liquid containment vessel, by exposing the liquid therein to a gas, such as ozone. If the air inlet port 10 is coupled to a source of ozone, ozone will be drawn into contact with the water within the pump 20 and filter 40, hence conditioning the water. Alternatively, an ozone conditioning system, which delivers ozone at a depth within a pool or other containment vessel, can utilize the gas compression resulting from use of this system to compress the ozone enough to deliver the ozone beneath the liquid surface. Other advantages and possible applications are apparent from the detailed description provided above by way of example, and from the accompanying drawings, and from the spirit and scope of the appended claims.

What is claimed is:

1. A swimming pool cleaning system, comprising in combination:

a water suction line having one end coupled to a swimming pool;

a compressed air supply line;

a water pump located on an end of said water suction line opposite said pool;

an air inlet port located on said water suction line, such that air can pass into said water suction line and be joined with water from the swimming pool; and means to extract compressed air from water on a side of said pump opposite said air inlet port, and deliver the compressed air to said compressed air supply line;

whereby said water pump pressurizes both water from said water suction line and air from said air inlet port.

2. The system of claim 1 wherein said pump is a pool filter circulation pump with said suction line having said one end coupled to the swimming pool through a pool cleaning device located within the pool; and wherein said system includes a filter located within a filter housing located on a side of said pump opposite said suction line and receiving water from said pump.

3. The system of claim 2 wherein said filter housing includes a compressed air outlet coupled to said compressed air supply line, said outlet located on an upper portion of said housing.

4. The system of claim 3 wherein a leaf basket is interposed between said pump and said pool cleaning device, along said suction line, said leaf basket including means to trap leaves and other debris from the water entering said pump.

5. They system of claim 1 wherein a pool cleaning device requiring compressed air for operation is coupled to said compressed air supply line.

6. The system of claim 5 wherein said pool cleaning device is coupled to said one end of said water suction line within said swimming pool.

7. A swimming pool cleaning system, comprising in combination:

a water suction line having one end coupled to a swimming pool;

a compressed air supply line;

a water pump located on an end of said water suction line opposite said pool;

an air inlet port located on said water suction line, such that air can pass into said water suction line; and means to extract compressed air from water on a side of said pump opposite said air inlet port and deliver the compressed air to said compressed air supply line;

whereby said water pump pressurizes both water from said water suction line and air from said air inlet port;

wherein said pump is a pool filter circulation pump with said suction line having said one end coupled to the swimming pool through a pool cleaning device located within the pool; and wherein said system includes a filter located within a filter housing located on a side of said pump opposite said suction line and receiving water from said pump;

wherein said filter housing includes a compressed air outlet coupled to said compressed air supply line, said outlet located on an upper portion of said housing;

wherein a leaf basket is interposed between said pump and said pool cleaning device, along said suction line, said leaf basket including means to trap leaves and other debris from the water entering said pump; and wherein said air inlet port is located between said leaf basket and said pump.

8. The system of claim 7 wherein said air inlet port includes a valve thereon preventing air from entering said suction line unless the water pressure within said suction line is less than atmospheric pressure.

9. The system of claim 7 wherein said air inlet port includes a valve thereon, said valve including:

an inner tube segment having an interior communicating with air in the atmosphere and an exterior opposite said interior, said inner tube segment including a hole between said interior and said exterior; and an outer sleeve, said outer sleeve formed of resilient material and having an inner surface adjacent said exterior of said inner tube segment, a covering portion of said outer sleeve covering said hole and an open portion of said outer sleeve, revealing a portion of said exterior of said inner tube segment, said open portion of said outer sleeve spaced from said covering portion of said outer sleeve.

10. A pool cleaning system, comprising in combination:

a water pump having a low pressure water inlet and a high pressure water outlet;

said low pressure water inlet located in position to receive water from a pool, said high pressure water outlet located in position to return water to the pool, a low pressure gas inlet port located between the pool and said low pressure water inlet of said pump, such that gas is allowed to enter said low pressure water inlet of said pump along with the water from the pool, and a high pressure gas outlet port located between the pool and said high pressure water outlet of said pump, such that gas is removed from the water after the water exits the high pressure water outlet of the pump and before the water returns to the pool.

11. The system of claim 10 wherein said gas inlet port includes a valve thereon, said valve including means to close said gas inlet port when said pump is not operating.

12. The system of claim 11 wherein said valve is a pressure sensitive valve including means to prevent gas from entering through said port unless water in said low pressure water inlet has a reduced pressure indicative of pump operation.

13. The system of claim 11 wherein said gas inlet port has an open end opposite said water suction line which is exposed to the surrounding atmosphere, such that air is included in the gas entering said water suction line when said valve is open.

14. The system of claim 10 wherein said high pressure gas outlet port extends from a top of a housing between the pool and said high pressure water outlet of said pump, such that water passing through said gas outlet port blows back down into said housing when said pump is turned off.

15. A pool cleaning system, comprising in combination:

a water pump having a low pressure water inlet and a high pressure water outlet, said low pressure water inlet located in position to receive water from a pool, said high pressure water outlet located in position to return water to the pool, a low pressure gas inlet port located between the pool and said low pressure water inlet of said pump, such that gas is allowed to enter said low pressure water inlet of said pump, and a high pressure gas outlet port located between the pool and said high pressure water outlet of said pump, such that gas is removed from the water before the water returns to the pool; and wherein a gas filter is provided on said high pressure gas outlet port, said gas filter including means to prevent water from passing through said gas outlet port while allowing gases to pass through said gas outlet port.

16. The system of claim 15 wherein a pressure sensitive valve is located on said low pressure gas inlet port, said valve including means to prevent gas from entering through said port unless water in said low pressure water inlet has a reduced pressure indicative of pump operation.

17. The system of claim 16 wherein said low pressure gas inlet port has an open end which is exposed to a container of treatment gas, such that the treatment gas is entered into the water when said pressure sensitive valve is open.

18. The system of claim 15 wherein a water suction line is located between said low pressure water inlet of said pump and said pool, said low pressure gas inlet port located on said water suction line such that when a pressure sensitive valve located on said low pressure gas inlet port is open, gas is allowed to pass into said water suction line and into said pump through said low pressure water inlet.

19. The system of claim 18 wherein said low pressure gas inlet port has an open end opposite said water suction line which is exposed to the surrounding atmosphere, such that air is included in the gas entering said water suction line when said pressure sensitive valve is open, and wherein said pressure sensitive valve is configured to allow air to pass into said water suction line only when a pressure within said water suction line is below atmospheric pressure.

20. The system of claim 15 wherein a compressed air supply line is coupled to said high pressure gas outlet port, said supply line interposed between said high pressure outlet port and a pool cleaning device located in the pool, said pool cleaning device including means to utilize compressed air to alter a vertical position thereof within the pool.

21. The system of claim 15 wherein a filter housing is located between said high pressure water outlet of said pump and said pool, said high pressure gas outlet port located on an upper end of said filter housing, such that high pressure air exiting said high pressure water outlet of said pump collects adjacent said high pressure gas outlet port.

22. The system of claim 15 wherein said gas filter is always open to allow air to exit said filter housing, while preventing water from exiting said filter housing through said high pressure gas outlet port.

* * * * *